US005992478A

United States Patent [19]

Micke et al.

[11] Patent Number: 5,992,478

[45] **Date of Patent: *Nov. 30, 1999**

[54] METHOD AND APPARATUS FOR FILLING CONTAINERS WITH GAS MIXTURES

[75] Inventors: Andre Micke, Summit; Martin Bülow, Basking Ridge, both of N.J.

[73] Assignee: The BOC Group, Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/679,417

[22] Filed: Jul. 8, 1996

[51] Int. Cl.[6] ..... B65B 31/00

[52] U.S. Cl. ..... 141/196; 141/2; 141/3; 141/4; 141/9; 141/18; 141/104; 141/105

[58] Field of Search ..... 141/2–4, 9, 18, 141/21, 104, 105, 196

[56] References Cited

U.S. PATENT DOCUMENTS

| | | | |
|---|---|---|---|
| 2,684,805 | 7/1954 | McBean | 141/9 X |
| 3,653,414 | 4/1972 | Weidner . | |
| 3,669,134 | 6/1972 | Dobritz | 137/7 |
| 4,219,038 | 8/1980 | Lubitzsch et al. . | |
| 4,585,039 | 4/1986 | Hamilton | 141/4 X |
| 4,688,946 | 8/1987 | Latif et al. . | |
| 4,698,160 | 10/1987 | Haraguchi . | |
| 5,345,980 | 9/1994 | Burt et al. | 141/3 |
| 5,351,726 | 10/1994 | Diggins | 141/4 |
| 5,353,848 | 10/1994 | Gates et al. | 141/9 |
| 5,427,160 | 6/1995 | Carson et al. | 141/4 |
| 5,586,587 | 12/1996 | Leininger et al. | 141/196 |
| 5,694,985 | 12/1997 | Diggins | 141/4 |

FOREIGN PATENT DOCUMENTS

| | | |
|---|---|---|
| 42 25 981 A1 | 10/1994 | Germany . |

*Primary Examiner*—J. Casimer Jacyna
*Attorney, Agent, or Firm*—Philip H. Von Neida; Salvatore P. Pace

[57] ABSTRACT

Gas cylinders are filled with mixtures of gases comprising a minor component, which is to be present in the mixture at a concentration of 10% or less of the total volume of the cylinder, and a major component, which is to be present at a concentration greater than about 10% of the total volume, by charging the lighter component into a chamber of given volume to a pressure and at a temperature such that the volume provides the desired fraction of minor component in the gas mixture, and then flushing the minor component into the cylinder using major component gas as the flushing agent. The pressure at which the minor component volume is to be measured is preferably at or near the final pressure of the filled gas cylinder.

15 Claims, 2 Drawing Sheets

METHOD AND APPARATUS FOR FILLING CONTAINERS WITH GAS MIXTURES

FIELD OF THE INVENTION

This invention relates to the filling of storage vessels with gas mixtures, and more particularly to a method and system for accurately filling gas cylinders with gas mixtures comprising one or more major components and one or more minor components. The invention also provides a procedure for more rapidly attaining a uniform mixture of gases being introduced into a gas cylinder, particularly when the gases have different molecular weights.

BACKGROUND OF THE INVENTION

Gases that are to be shipped to various locations are generally packaged in portable vessels of various shapes and sizes which are capable of withstanding high pressures and which can be conveniently shipped. Typical of such vessels are the cylindrical containers commonly known as gas cylinders or bottles. These vessels are generally filled with gases by charging the gas into the vessel until the desired pressure is reached. The procedure is relatively simple and problem-free when the gas cylinder is to contain a single gas, or a mixture of gases of similar molecular weight where the concentration of each gas in the mixture is fairly high and not critical. However, when a gas container is to be filled to high pressure with a gas mixture comprising a large concentration of one component, for example concentrations of 75 volume % or more, and small quantities of one or more other components, for example concentrations of 10 volume % or less of each minor component, it is much more difficult to precisely measure the quantities of the low concentration gases.

A conventional procedure for filling gas cylinders with gas mixtures comprising a minor component and a major component is to first introduce the minor component into the cylinder using a low pressure gauge, and then introduce the major component into the cylinder to the desired end pressure using a high pressure gauge. Since precision pressure gauge readings are usually accurate to within about 0.1% of full scale, the error will be small when this procedure is used. Disadvantages of this method are that different gauges are required for measuring the components of the gas mixture and measurements of gas volumes based on pressures is not highly accurate due to the non-ideal nature of gas mixtures, particularly at high pressures. A further disadvantage arises if the minor compound is heavier than the major component. In this case, the first-filled minor component remains separated at the bottom of the gas cylinder for a prolonged period of time.

Methods and systems for accurately filling vessels with gas mixtures have been considerably investigated. U.S. Pat. No. 3,653,414 discloses a system and method for charging a thermostat with a mixture of a condensable medium and a noncondensable gas. The noncondensable gas is first introduced into the sensor of the thermostat to a predetermined pressure, measured by a first pressure gauge. A quantity of the condensable medium, measured by difference in pressure using a second pressure gauge, is then introduced into the sensor.

U.S. Pat. No. 3,669,134, discloses a gas measuring method in which two gases are charged into separate chambers using separate pressure regulators that are interconnected in such a manner that the pressures of the gases are in a predetermined ratio. The apparatus and method disclosed in this patent is complex and difficult to apply, particularly when it is desired to produce mixtures of three or more gases.

U.S. Pat. No. 4,219,038 discloses a gas mixing device for mixing a plurality of gases wherein each gas flows through a line that has a pressure regulator. In one embodiment of the disclosed invention the individual gases are stored in batteries of containers.

U.S. Pat. No. 4,688,946 discloses a method of mixing a liquid organic compound and a liquid propellant involving filling a metering cylinder with the liquid organic compound and then forcing the liquid organic compound, together with a predetermined volume of liquid propellant, into a mixing vessel.

U.S. Pat. No. 4,698,160 discloses apparatus for mixing two fluids for use in hemodialysis. Syringe type piston pumps are used to measure and force one or more of the components of the mixture into a mixing vessel.

U.S. Pat. No. 5,353,848 discloses procedure for accurately metering the components of a gas mixture into a gas cylinder while avoiding gas stratification, by introducing the gases into the cylinder in the order of their molecular weights using a differential pressure gauge.

U.S. Pat. No. 5,427,160 discloses a method of charging an oxidant gas and a flammable gas into a storage vessel wherein separate measuring chambers are used for each gas. The residual gas in the system lines is vented from the system.

Various efforts have been undertaken to effect a more rapid mixing of gas mixtures in cylinders. One technique is to introduce the lighter gas component into the bottom part of the cylinder by means of a mixing tube. This will force the lighter gas to migrate upwardly through the heavier gas, thereby causing the gases to mix. Another technique is to roll the cylinders until the contents are uniformly mixed. Each of these procedures requires considerable handling of the cylinders, which increases the cost of filling the cylinders with gas mixtures. A third method, described in U.S. Pat. No. 5,353,848, mentioned above, is to introduce first the lighter component and then the heavier component into the cylinder. In the last method mixing of the gases is accelerated due to the upward mobility of the lighter component and the downward mobility of the heavier component of the gas mixture.

Because of the importance of providing containerized gas mixtures in which the components of the mixtures are in precise composition, and the need to attain almost immediate homogeneity of vessel-contained gas mixtures, improved gas vessel filling methods are continuously sought. The present invention provides method and system which accomplishes these objectives.

SUMMARY OF THE INVENTION

According to the process of the invention, a gas vessel is charged to a desired pressure with a precisely measured gas mixture comprising a major component and one or more minor components by the method comprising:

(a) for each minor component that is to be a part of the gas mixture, charging the minor component into a gas measuring system of specified volume to a specific pressure measured at a temperature that will provide the desired quantity of the minor component, and transferring substantially all of the measured quantity of the minor component to the gas vessel; and (b) charging the gas vessel with the major component to the specified pressure at a temperature that will provide the desired quantity of the major component.

In one embodiment of the process of the invention, at least one of the minor components is lighter than the major component. In this embodiment, the lighter minor component or components are preferably charged into the gas vessel before the major component is charged into the gas vessel.

In another embodiment of the process of the invention, at least one of the minor components has a molecular weight greater than that of the major component. In this embodiment the minor component or components that have molecular weights greater than that of the major component are preferably charged into the gas vessel after at least part of the major component is charged into the gas vessel.

In either of the above embodiments the components of the gas mixture are preferably charged into the gas vessel in the order of their increasing molecular weights.

In a preferred aspect of the invention a portion of the major component is mixed with each minor component prior to or during introduction of the minor component into the gas vessel. This is most preferably accomplished by flushing each minor component from the measuring system with a portion of the major component.

The measuring system used in the invention may comprise one or more chambers of fixed volume. The chambers may all have the same volume or their volumes may differ from each other. In a variation of the invention the measuring system comprises a single chamber having an adjustable volume. When a single chamber having an adjustable volume is used, the chamber is preferably cylindrical and its volume is preferably adjusted by movement of a piston-like plunger. In a preferred embodiment of either of these alternatives, the volume selected for measurement of the desired quantity of each minor component and the temperature at which each measurement is made are such that the pressure at which the measurement is made is within 10% (plus or minus) of the desired pressure, i.e. the final pressure to which the chamber is to be charged.

The apparatus used in the invention generally comprises a gas measuring system capable of holding a portion or all of the desired quantity of any minor component of the gas mixture at a selected temperature and pressure; a pressure sensing means; means for transmitting the pressure in the gas measuring system and in the gas vessel being filled with the gas mixture to the pressure sensing means; conduit means for separately flowing the major component and each minor component of the desired gas mixture into the gas measuring system; means for controlling the flow of each minor component of the gas mixture into the gas measuring system in response to a signal from the pressure sensing means; and conduit means for transferring a measured quantity of gas from the gas measuring system to a gas vessel which is to be charged with the gas mixture.

BRIEF DESCRIPTION OF THE DRAWINGS

The same reference numerals are used to represent the same or similar parts in the various drawings. Only lines, valves and equipment necessary for a clear understanding of the invention have been included in the systems illustrated in the drawings.

DETAILED DESCRIPTION OF THE INVENTION

The invention is designed to facilitate accurate measurement of the quantities of each component of a gas mixture comprised of one or more major components and one or more minor components, and to more rapidly attain a homogeneous blend of components of the gas mixture that have different molecular weights. For purposes of this description, a gas that is heavier than another gas has a greater molecular weight than the other gas and a gas that is lighter than another gas has a lower molecular weight than the other gas. A "minor component" is defined as a gas component which is present in the gas mixture at a concentration of less than 10% and whose concentration in the gas mixture is critical, i.e. important, and is being measured by the process of the invention. Unless otherwise indicated all percentages referred to in this description are expressed on a mole fraction basis. The invention is generally useful for charging vessels with gas mixtures comprising one or more minor components that are to be present in the product gas mixture at concentrations in the range of about 0.5 to about 10% of the total volume of gas to be charged into the vessel, and is particularly advantageous for charging gas vessels with gas mixtures in which one or more minor components are to be present in the gas mixture at concentrations in the range of about 0.5 to about 5% by volume of the gas mixture. Major components of gas mixtures prepared in accordance with the principle of the invention are those that are present in the gas mixtures at concentrations greater than 10% by volume. Unless otherwise specified, parts percentages and ratios expressed herein are on a volume or mole basis.

The gas mixture may comprise one or more minor components and one or more major components. Examples of gas mixtures that can be prepared in accordance with the invention are binary gas mixtures consisting of nitric oxide as the minor component and nitrogen as the major component, ternary mixtures consisting of nitrogen and argon as the minor components and helium as the major component. The major component may itself be a gas mixture which, for purposes of the invention, is treated as a single gas. An example of such a gas mixture is air. For purposes of this invention the argon present in the air is not considered as a minor component even though its concentration is less than 10%, unless, of course, its concentration in the gas mixture is critical.

Figure 1:
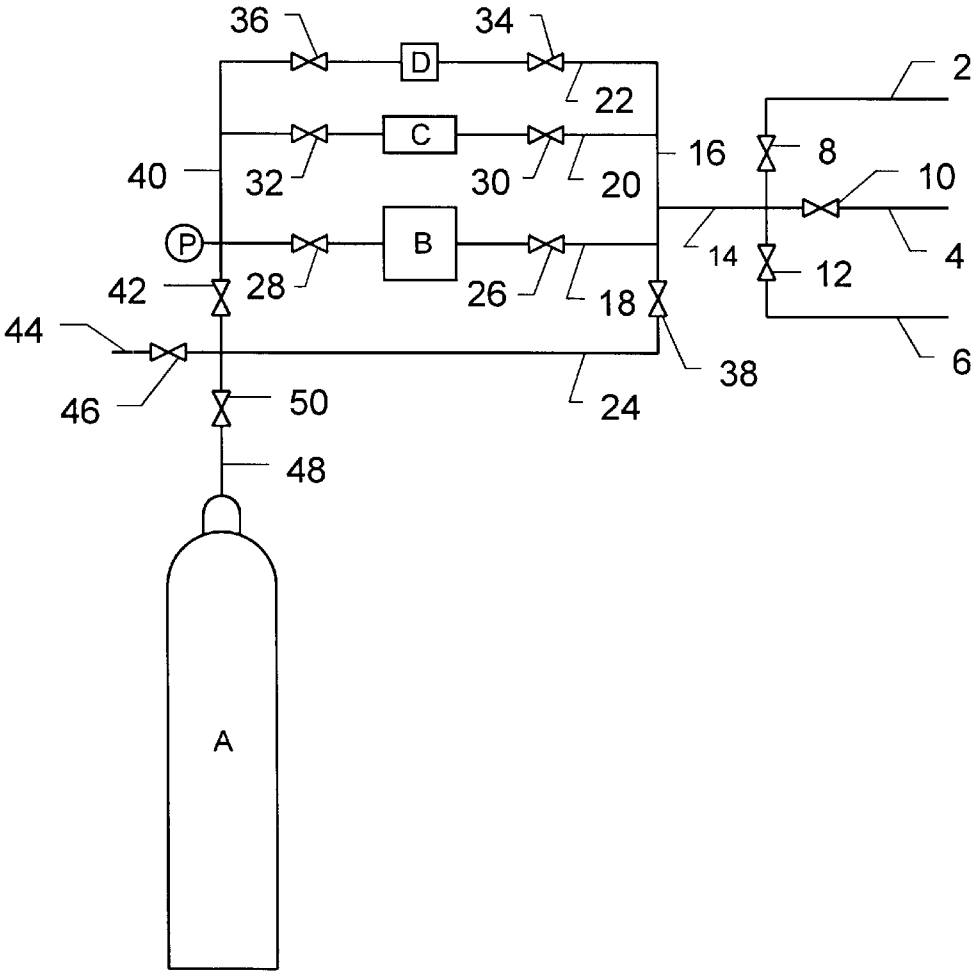
FIG. 1 illustrates one embodiment of a system for filling gas vessels with accurately measured quantities of each component of a gas mixture.

The appended drawings will facilitate explanation of the invention. The drawings exemplify preferred embodiments of the invention but are not intended to limit its scope. Turning now to FIG. 1, there is shown therein a system for filling a gas cylinder A with a mixture of gases in accordance with the method of the invention. Lines 2 and 4, fitted with valves 8 and 10, respectively, are connected to sources of first and second minor gas components of the mixture to be charged into cylinder A, and line 6, fitted with valve 12, is connected to a source of a major gas component of the desired mixture. Lines 2, 4 and 6 are joined to line 14, which, in turn, is connected to manifold 16. Manifold 14 is connected to volume measuring chambers B, C and D, which are located in lines 18, 20 and 22, respectively. and to measuring system by-pass line 24. Line 18 is provided with shutoff valves 26 and 28, which are respectively located upstream and downstream of measuring chamber B; line 20 is provided with shutoff valves 30 and 32, which are respectively located upstream and downstream of measuring chamber C; and line 22 is provided with shutoff valves 34 and 36, which are respectively located upstream and downstream of measuring chamber C. Downstream of valves 28, 32 and 36, lines 18, 20 and 22 are connected to manifold 40. Line 40 is provided with pressure sensor P and valve 42. Bypass line 24, vent line 44, fitted with valve 46, and cylinder fill line 48, fitted with valve 50 are connected to line 40 downstream of valve 42.

The measuring system of FIG. 1 is illustrated as comprising three measuring chambers of different volumes; however the system may comprise a single chamber, for example chamber B, or it may comprise two or more chambers of the same size or different sizes. The volume of chamber B is preferably a small, round number percentage, for example 1%, of the volume of vessel A. In the system of FIG. 1, the volume of chambers C and D are depicted as being one-half and one-quarter, respectively, of the volume of chamber B.

In the FIG. 1 system as illustrated, the measured volume includes the volume of the measuring chambers that are used in the volume measurement and the volume of the lines that are in fluid communication with pressure sensing device P during filling of the measuring chamber with the minor gas component. For example, if only chamber B is used in the measurement, valves 30, 32, 34 and 36 are closed and the measured volume includes the volume of line 18 downstream of valve 26, the volume of lines 20 and 22 downstream of valves 32 and 36 and the volume of line 40 upstream of valve 42. Similarly, if only chamber C is used in the gas measurement, valves 26, 28, 34 and 36 are closed, and the measured volume includes the volume of measuring chamber C, the volume of line 20 downstream of valve 30, the volume of lines 18 and 22 downstream of closed valves 28 and 36, and the volume of line 40 upstream of valve 42. When only measuring chamber D or combinations of two or all three measuring chambers are used the measured volume is determined in the same manner, i.e. the volumes of all lines that are in fluid communication with pressure sensor P are included in the measurement. It is assumed that the construction of the system is such that the volume of gas contained in the common lines upstream of valves 26, 30 and 34 is negligible. If such is not the case, the system lines can be evacuated and/or flushed with major component gas after isolation of the measured gas in chambers B and/or C and/or D, and before transfer of the measured gas to cylinder A.

Figure 2:
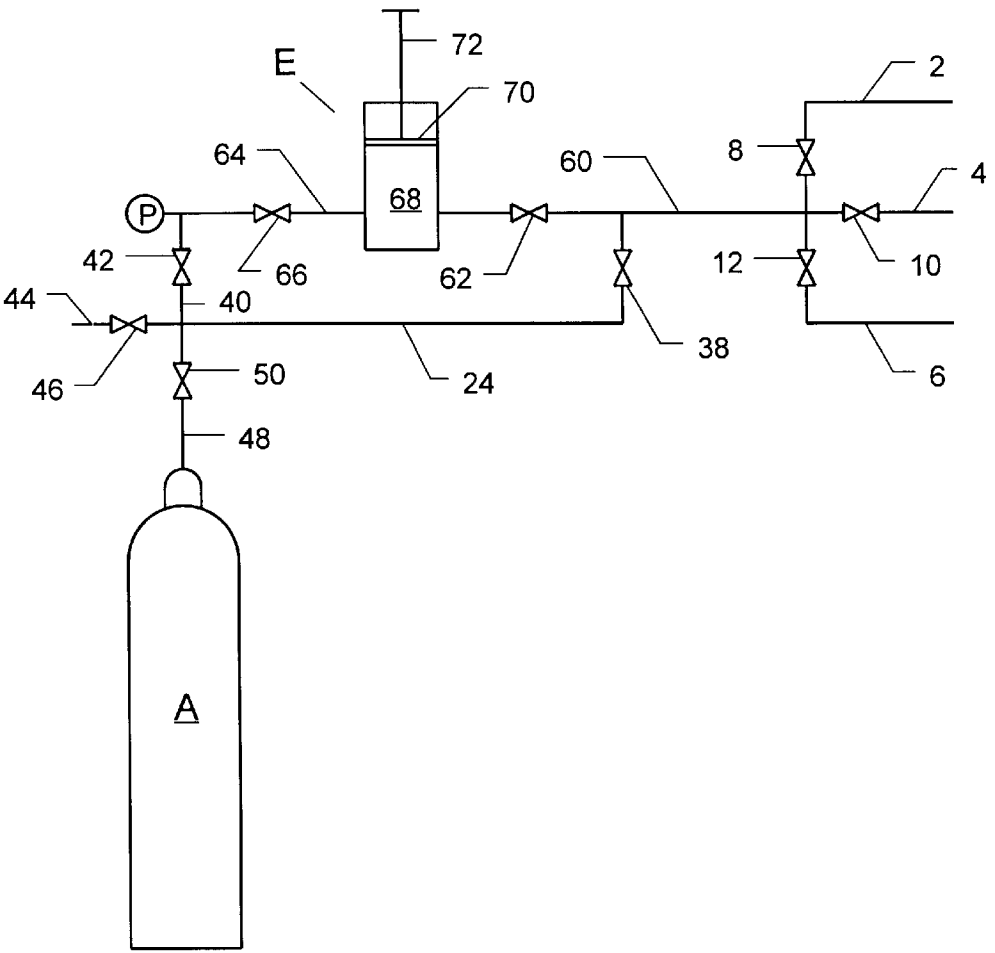
FIG. 2 illustrates an alternate embodiment of the system of FIG. 1.

The measured volume of the minor gas component in the system of FIG. 2 is the volume of chamber 68, the volume of line 60 downstream of valve 62, the volume of line 64 and the volume of line 40 upstream of valve 42.

The arrangement of measuring chambers and associated valving shown in FIG. 1 makes it easy to accurately measure the volumes of minor gas components of a desired mixture of gases which constitute a small, round number percentage of the volume of vessel A. In the illustrated arrangement any combination of measuring chambers can be used for accurate measurement of the desired volume of a minor gas component based on the gas laws.

FIG. 2 shows a system similar to the FIG. 1 system except that the fixed volume measuring chambers are replaced by volume gauge E. In the FIG. 2 system lines 2, 4 and 6 are connected to line 60, which, in turn, is connected to the inlet end of measuring chamber E. Line 60 is provided with shutoff valve 62. Line 64, which is provided with shutoff valve 66, joins the outlet end of chamber E to line 40. Volume gauge E is provided with gas measuring chamber 68, the volume of which is determined by the position of piston 70.

Piston 70 also serves to force the measured gas from chamber 68 when piston shaft is forced downwardly. The position of piston 70 is set by manipulation of handle 72. The position of piston 70 can be set automatically by means of a servo motor, if desired.

In the system of FIG. 2, the measured volume of the minor gas includes not only the volume of gas in chamber 68, but also the volume of gas in line 60 downstream of valve 62 and the volume of gas in line 64 upstream of valve 66.

In practicing a preferred embodiment of the process of the invention using the system of FIG. 1, a vessel (A) to be filled with the desired gas mixture is connected to line 48, and the system, including the measuring chamber or combination of measuring chambers that will provide the quantity of minor gas component desired in the gas mixture being prepared is evacuated to permit precise measurement of the minor gas component. This is accomplished by opening valves 38, 42, 46 and the appropriate one or more of valves 28, 32 and 36, and maintaining and all other valves in the closed position. The measuring chamber(s) are evacuated by connecting line 44 to a vacuum source (not shown). Lines above valves 26, 30 and 34 are evacuated during the evacuation step through open valve 38. When the measuring chamber(s) are evacuated to the desired extent, valves 38, 42 and 46 are closed and the valve controlling flow of the desired minor gas component into the system (valve 8 or valve 10) and the appropriate one or more of pairs of valves 26 and 28, 30 and 32, and 34 and 36 are opened. The minor gas component is then charged into the selected measuring chamber until the pressure in the chamber(s) reaches the value that will provide the desired quantity of minor gas component at the selected volume and temperature. The desired pressure is determined by means of calculations based on the real gas equations of state. This determination is preferably made by computer using sufficiently accurate approximations provided by the equations of state. When the desired pressure is attained, as indicated by pressure sensor P, valve 8 or valve 10 (whichever is open) and the valves immediately upstream and downstream of the particular measuring chamber or combination of measuring chambers being used (i.e. valves 26 and 28 and/or valves 30 and 32 and/or valves 34 and 36) are closed. Valves 38, 42 and 46 are then opened and the system upstream and downstream of the selected measuring chamber(s) is again evacuated. Upon completion of the evacuation step, valves 38 and 46 are closed and valves 12, 42 and 50 and those valves immediately upstream and downstream of the selected chambers are opened, and the measured minor component is swept into vessel A with major gas component from line 6. This procedure serves to completely flush all minor component from the measuring chamber(s) and to mix the minor component with the major component. This procedure is repeated using the same minor gas component as charge gas, if it is necessary to charge more than one volume of the selected chamber(s) into vessel A to provide the desired composition.

If the gas mixture being prepared is to contain more than one minor gas component the above procedure is repeated for each additional minor component. The minor components are preferably measured and introduced into vessel A in the order of their increasing molecular weights. In other words, the lightest gas is introduced into vessel A first, then the next lightest gas, etc., until all minor components have been charged into vessel A. Vessel A is then charged with the desired major component (or components) until vessel A is filled to the desired pressure.

If a major component of the desired gas mixture is lighter than one or more of the minor gas components, most of the major component to be charged into vessel A is first introduced into vessel A. Sufficient major component is retained, however to provide adequate flushing of the measuring chamber(s) to ensure that all of the measured minor component is charged into vessel A. By introducing the components into vessel A in the order indicated above, the need for subsequent blending of the components of vessel A is minimized or eliminated. If the major component is introduced into vessel A prior to the introduction of minor component, this can be accomplished by opening bypass valve 38 and valve 50 and directly charging major component into vessel A.

It can be appreciated that if the lines upstream of valves 26, 30 and 34 are of sufficiently small volume to be ignored in measuring the quantities of minor components of the gas mixture, they need not be flushed with major component prior to flushing the measuring chamber(s) with major component.

Practice of the process of the invention using the system of FIG. 2 is similar to, but somewhat simpler than, the procedure described above. In using the system of FIG. 2, the desired volume of chamber 68 is selected by raising or depressing piston 70 by means of handle 72. The system, including gas measuring chamber 68 is then evacuated by opening valves 38, 42, 46 and 66 and drawing a vacuum on line 44. Valves 38, 42 and 46 are then closed and the lightest of the minor components is charged into chamber 68 by opening valve 62 and the appropriate one of valves 8 and 10 and charging chamber 68 with the minor component until the desired pressure is attained. Valves 62 and 66 are then closed and valves 38, 42 and 46 are opened and the system upstream of valve 62 and downstream of valve 66 is evacuated. Upon completion of the evacuation step valves 38 and 46 are closed valves 12, 62 and 66 are opened, and valve 42 is maintained in the open position, and the minor component is flushed into vessel A with major component in the manner described above. Prior to flushing chamber 68 with major component, the minor component can be ejected from chamber 68 by depressing piston 70, if this is desired. The procedure is repeated with the same minor gas, if necessary, until the desired quantity of the selected minor component is charged into vessel A, and is repeated for each minor component that is to be charged into vessel A.

As was the case with the process described for use of the system of FIG. 1, in the process practiced using the system of FIG. 2, the major component or components are charged into vessel A in the order of increasing molecular weights.

The pressure at which the volume measurements of the minor components are made is a matter of choice. It is preferred, however, that these measurements by made at or near the final pressure to which vessel A is to be charged, so that errors in measurement will be minimized. In preferred embodiments the pressure at which the volume measurements are made is within 10 percent of the pressure to which vessel A is to be filled.

It will be appreciated that it is within the scope of the present invention to utilize conventional equipment to monitor and automate the vessel filling procedure so that the system can be operated in an efficient manner.

The invention is further illustrated by the following hypothetical example, in which, unless otherwise indicated, parts, percentages and ratios are expressed on a molar basis. The FIG. 2 system is used as a model in the example.

EXAMPLE

In this example, a 100 liter gas cylinder is to be filled with a gas mixture containing 98% nitrogen (molecular weight=28.013 g/mol) and 2% xenon (molecular weight=131.29 g/mol), with the final pressure of the gas mixture in the cylinder at 21° C. being 200 bar, absolute (bara). Lines 2 and 4 (FIG. 2) are connected to pressurized sources of xenon and nitrogen, respectively. The gas behavior was calculated using a 32 parameter modification of the Benedict-Webb-Rubin equation of state: for nitrogen, as described in Younglove B. A., *J. Phys. and Chem. Ref. Data,* 1982, vol 11, p 1; and for xenon, as described in Rabinovic, V. A., Vasserman, A. A., Nedostup, V. I. and Veksler, L. S., *Thermophysical Properties of Ne, Ar, Kr and Xe*, National Standard Reference, Data Service of the USSR, Hemisphere Pub. Co., Springer, Berlin, 1988. The gas mixture data was calculated using the principle of corresponding states.

Based on the above references the number of moles of xenon and nitrogen present in a gas mixture having a volume of 100 liters, calculated at 21° C. and 200 bara, is 15.67 and 768, respectively.

The cylinder filling procedure is as follows: Piston 70 of volume gauge E is adjusted so that the volume of chamber 68 is one liter. Valves 38, 42, 46, 50, 62 and 66 are opened (all other valves are closed), and a vacuum is drawn on the system through line 44. The system, including cylinder A is evacuated. Valves 38, 42, 46 and 50 are closed. The pressure required to charge 15.67 moles of xenon into a 1 liter chamber at 21° C. is 157.21 bara. Valve 8 is opened (valves 62 and 66 remain open) and xenon is charged into chamber 98 until the pressure reading on gauge P is 157.21 bara, measured at 21° C. Valves 8, 62 and 66 are closed and valves 38, 42, 46 and 50 are opened and the system is again evacuated. Upon completion of the evacuation step, valve 46 is closed and valve 10 is opened and one half of the nitrogen calculated above (384 moles) charged into cylinder A via bypass line 24. The pressure to which cylinder A is charged with nitrogen to provide 384 moles of nitrogen is 93.9 bara (determined for 21° C. using the above reference data). Upon attainment of this pressure, as indicated by pressure gauge P, valve 38 is closed and valves 62 and 66 are opened, and the xenon in chamber 68 is swept into cylinder A by additional nitrogen from line 4. During the course of the cylinder filling step the temperature inside cylinder A may rise (a rise to 30° C. is assumed). Based on this new temperature the final pressure required to fill cylinder with the desired gas mixture is 208.7 bara. When this pressure is attained valves 10 and 50 are closed, thereby completing the filling of vessel A with the desired gas mixture.

Upon completion of the filling process, sampling of the cylinder A will show that the gas mixture is uniformly blended and that the molar concentration of xenon throughout vessel A is 2% (molar).

The above example illustrates operation of the invention when a gas cylinder is to be filled with a two-component gas mixture comprising a minor amount of a first gas and a major amount of a second gas, wherein the first gas is heavier than the second gas. Since nitrogen is lighter than xenon one-half of the nitrogen was transferred into cylinder A prior to transfer of the xenon into cylinder A to facilitate mixing of the gases in the cylinder. The procedure can be used to accurately prepare other gas mixtures. For example, if the minor component is the lighter component and the major component is the heavier component, the minor component is preferably transferred into cylinder A before the heavier component is charged into cylinder A.

Although the invention has been described with particular reference to specific equipment arrangements and to specific experiments, these features are merely exemplary of the invention and variations are contemplated. For example, in the system of FIG. 1, a single replaceable measuring chamber can be substituted for the illustrated multi-chamber system. In this case, a chamber of the desired volume at the target pressure can be selected from an inventory of various sized chambers, and the selected chamber inserted into the system. This can be conveniently accomplished using a system arrangement similar to that illustrated in FIG. 2, with the selected fixed volume chamber substituted for measuring chamber E. The scope of the invention is limited only by the breadth of the appended claims.

What is claimed is:

1. A method for filling a gas vessel of known volume to a target pressure with at least two gases to form a gas mixture comprised of a major gas component and at least one minor gas component comprising:

(a) for each minor gas component of said gas mixture, charging said minor gas component into a gas measuring system of specific volume to a predetermined pressure, said specific volume of said minor gas component at said predetermined pressure and the current temperature of said minor gas component being the quantity of said minor gas component that it is desired to introduce into said vessel, as determined by real gas equations, and transferring substantially all of the measured minor gas component to said vessel; and (b) charging said vessel to said target pressure with said major gas component.

2. The method of claim 1, wherein the molecular weight of at least one of said minor gas components is less than the molecular weight of said major gas component.

3. The method of claim 2, wherein at least part of each minor gas component that has a molecular weight less than the molecular weight of said major gas component is charged to said vessel prior to said major gas component.

4. The method of claim 1, wherein the molecular weight of at least one of said minor gas components is greater than the molecular weight of said major gas component.

5. The method of claim 4, wherein at least part of each minor gas component that has a molecular weight greater than the molecular weight of said major gas component is charged to said vessel subsequent to said major gas component.

6. The method of claim 1, wherein the target concentration of at least one of said minor gas components in said vessel is about 0.5 to about 10% by volume.

7. The method of claim 1, wherein at least one of said minor gas components is combined with major gas component prior to being charged into said vessel.

8. The method of claim 7, wherein at least residual amounts of said minor gas components are removed from said gas measuring system by flushing said gas measuring system with said major gas component.

9. The method of claim 1, wherein the volume of said gas measuring system is variable.

10. The method of claim 9, wherein said gas measuring system comprises a plurality of gas chambers of fixed volume.

11. The method of claim 10, wherein the volume of a minor gas component is measured by pressurizing two or more of said gas chambers to said predetermined pressure with said minor gas component.

12. The method of claim 9, wherein said gas measuring system comprises a chamber having an adjustable volume.

13. The method of claim 12, wherein the volume of a minor gas component is measured by adjusting the volume of said chamber to a specified value and pressurizing said chamber to said specified pressure with said minor gas component.

14. The method of claim 1, wherein the said predetermined pressure is within 10% of said target pressure.

15. The method of claim 1, wherein said predetermined pressure is said target pressure.

* * * * *